United States Patent [19]

Infeld

[11] 4,224,857

[45] Sep. 30, 1980

[54] TUNABLE STRING HOLDER FOR MUSICAL INSTRUMENT

[75] Inventor: Peter Infeld, Vienna, Austria

[73] Assignee: Dr. Thomastik und Mitarbeiter Ohg, Vienna, Austria

[21] Appl. No.: 952,684

[22] Filed: Oct. 19, 1978

[30] Foreign Application Priority Data

Oct. 21, 1977 [AT] Austria ..... 755577

[51] Int. Cl.[3] ..... G10D 3/12

[52] U.S. Cl. ..... 84/302; 84/207; 84/312 R

[58] Field of Search ..... 84/297 R, 300–302, 84/312, 205–207

[56] References Cited

U.S. PATENT DOCUMENTS

| | | | |
|---|---|---|---|
| 237,528 | 2/1881 | Hebard | 84/205 |
| 459,603 | 9/1891 | Tuebnee | 84/297 R |
| 2,196,817 | 4/1940 | Sottnek | 84/297 R X |
| 2,322,137 | 6/1943 | Janch | 84/312 |
| 3,048,073 | 8/1962 | Farr | 84/205 |
| 3,443,467 | 5/1969 | Richards | 84/312 X |
| 3,688,630 | 9/1972 | Tartaglia | 84/302 |

FOREIGN PATENT DOCUMENTS

| | | | |
|---|---|---|---|
| 205210 | 6/1939 | Switzerland | 84/302 |
| 20912 | 11/1900 | United Kingdom | 84/302 |

*Primary Examiner*—Lawrence R. Franklin
*Attorney, Agent, or Firm*—Montague & Ross

[57] ABSTRACT

A string holder for a string instrument comprises a support which is secured for the string instrument and formed with a plurality of generally parallel longitudinal guides in each of which a respective support block can be displaced through a relatively long longitudinal distance. This block can be locked at any location along the respective guide. Each of the blocks carries a two-arm lever one of whose arms is secured to the respective string and the other of whose arms is acted on by a screw for displacement of the one arm through a relatively short distance for fine tuning of the distance between bridge and anchor point for the respective string.

10 Claims, 4 Drawing Figures

TUNABLE STRING HOLDER FOR MUSICAL INSTRUMENT

FIELD OF THE INVENTION

The present invention relates to a string holder for a string instrument. More particularly, this invention concerns such a holder which is tunable and usable on a violin or the like.

BACKGROUND OF THE INVENTION

In a string instrument the vibrations in the sound body are transmitted to the bridge supported thereon and therethrough to the end piece or connection part of each of the strings which extend between the bridge and the string holder or tailpiece of the instrument. Thus the vibrations of each of the strings are transmitted to the sound body of the instrument and then back through the bridge to the end pieces of the strings. For this reason a phase shift can exist between the sympathetic vibration of the end pieces of the strings and the vibration in the sound body, depending on the reaction frequency to which each of these string end pieces is tuned. This so-called reaction frequency is determined by the diameter, tension, and length of the string end piece.

The result is occasionally disturbing vibrations which combine with the desired vibrations or subtract from them to produce a sound which is occasionally far from the desired sound.

When this effect is excessively dominant a good musician will frequently tip or displace the bridge, or shorten the tail piece. It is also kown to mute the end pieces of the strings or otherwise damp vibrations thereof.

OBJECTS OF THE INVENTION

It is an object of the instant invention to overcome the above-given disadvantageous musical and acoustic effect in a string instrument.

Another object is to provide an improved string holder for a string instrument.

SUMMARY OF THE INVENTION

These objects are attained in a string-instrument string holder which has a support adapted to be secured to the string instrument and formed with a plurality of generally parallel longitudinal guides in each of which a support block is displaceable through a relatively long longitudinal distance. Each of these blocks can be arrested at any of a multiplicity of longitudinally offset positions in the respective guide. String anchors secured to respective strings of the instrument are displaceable on the respective blocks through relatively short longitudinal distances and can be steplessly displaced and fixed on the respective block.

Thus, it is possible for the effective length of the end piece of each of the strings to be adjusted between the bridge and the anchor point for the string. The amount of adjustment is considerable so that the coarse adjustment can first be set and then the fine adjustment regulated to obtain the exact length desired. This system therefore allows the harmonic length of each of these end sections to be individually adjusted, so that variation in string diameter or tension can easily and rapidly be compensated for.

According to further features of this invention the displacement of the anchor for fine tune is effected by forming the anchor as a 2-arm lever pivoted on the respective support block. The string is secured to one end of this lever and a screw threaded through the respective support block bears on the other end, so that turning of the end on this screw by the fingers allows very accurate and fine adjustment by rocking or pivoting of the anchor.

The coarse turning is effected in accordance with one arrangement of this invention by mounting the slide blocks each on a respective threaded spindle extending longitudinally along the respective guide. Rotation of each of the spindles screws the respective block in the appropriate direction for coarse tunning. It is also within the scope of this invention to form each of the guides with a row of teeth engageable with a formation on the respective block. A screw can clamp each of the blocks in any desired position along this tooth guide for the coarse setting of the adjustment mechanism.

SPECIFIC DESCRIPTION

Figure 1:
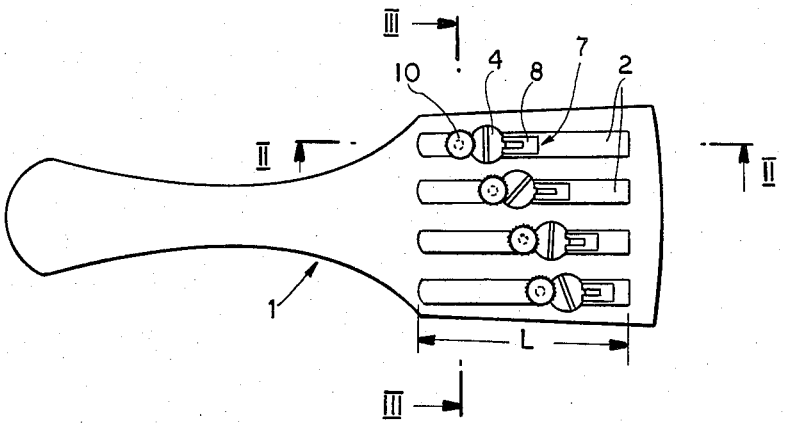
FIG. 1 is a top view of a string holder according to this invention.
Figure 3:
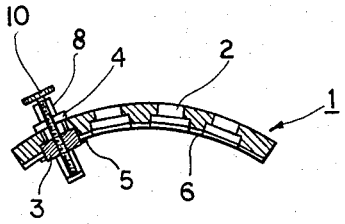
FIGS. 2 and 3 are sections taken respectively along lines II—II and III—III of FIG. 1.
Figure 2:
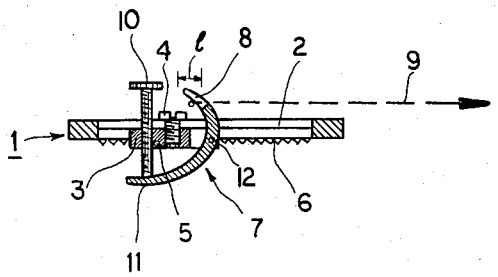

As shown in FIGS. 1–3 a string holder according to this invention has a support 1 which is normally secured to the body of a string musical instrument, here a violin, adjacent the bridge thereof. This support 1, which is formed of metal, is formed with four identical guide tracks or slots 2 in which respective support blocks 3 can be slid through relatively long distances L. The support 1 is formed underneath each of the tracks 2, which is a T-section slot, with a row of teeth 6 in which may engage a transversely projecting pin 5 of each of the blocks 3. A screw 4 is provided on each of the blocks with its head bearing against the upper side of the support 1 and its threaded portion engaged in a bore of the respective block 3. When one of the screws 4 is tightened the corresponding block 3 is clamped against the lips of the respective slot 2 and the respective pin 5 is engaged between the teeth of the respective row 6.

In addition, each of these blocks 3 carries an anchor element constituted as a two-arm lever 7 having one arm constituted as a fork 8 in which is engaged the end of the respective string 9 and another arm 11 against which bears a knurl-headed screw 10 threaded through the respective block 3. A pivot 12 is provided between the arms 8 and 11 for rocking of the portion 8 through a relatively short distance 1 equal here to approximately one-fifth of the distance L.

In use a string 9 is fitted in the respective end 8 and the respective block 3 is positioned at approximately the right distance from the bridge, then its screw 4 is tightened to lock it in place. Thereafter the instrument is tuned and the screw 10 is adjusted until the desired harmonic relationship is obtained. A skilled musician with a small amount of practice will be able readily and accurately to establish the right relationships. Normally the distance between bridge and attachment points is longer for the lower notes than for the higher notes.

Figure 4:
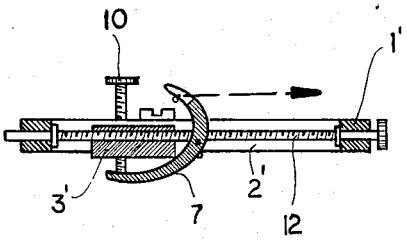
FIG. 4 is a view similar to FIG. 2 showing another arrangement in accordance with this invention.

FIG. 4 shows another arrangement wherein a screw 12 is threaded through a block 3' and is axially fixed in a support 1'. Thus rotation of the screw 12 moves the block 3' along the respective track 2' for coarse adjustment. Otherwise a screw 10 adjusts the anchor piece 7 in the manner described above.

I claim:

1. A violin tailpiece for anchoring longitudinally extending violin strings that are spanned over a bridge, said tailpiece comprising:

a support adapted to be secured to a string instrument and formed with a plurality of generally parallel longitudinal guides;

respective support blocks displaceable through relatively long longitudinal distances in said guides;

means for arresting each of said blocks at any of a multiplicity of longitudinally offset positions in the respective guide;

respective string anchors securable to respective strings of said instrument and displaceable on the respective blocks through relatively short longitudinal distances; and means for steplessly displacing each of said anchors through said short distances on the respective block and for fixing each of said anchors against displacement on the respective block.

2. The tailpiece defined in claim 1 wherein said string anchors are each a two-arm lever having one arm connectable to the respective string, another arm engageable with said means for steplessly displacing, and a central region pivoted on the respective block.

3. The tailpiece defined in claim 2 wherein said levers are pivoted on the respective blocks about axes perpendicular to the respective strings.

4. The tailpiece defined in claim 2 wherein said means for steplessly adjusting includes respective screws threadedly engaged between said other arms and the respective blocks.

5. The tailpiece defined in claim 4 wherein each of said screws is threaded into the respective block and bears on the respective other arm.

6. The tailpiece defined in claim 1 wherein each of said guides is a longitudinally extending track formed in said support, each block being slidable in the respective track.

7. The tailpiece defined in claim 6 wherein said means for arresting includes respective threaded spindles anchored in said support and each extending along and threaded in a respective block, whereby rotation of said spindles longitudinally displaces said blocks.

8. The tailpiece defined in claim 6 wherein said means for arresting includes respective rows of teeth formed along said tracks, a formation on each of said blocks engageable in the respective row of teeth, and means for lockingly engaging each of said formations with the respective row of teeth.

9. The tailpiece defined in claim 8 wherein said means for lockingly engaging includes respective screws engageable between said blocks and said support.

10. The tailpiece defined in claim 1 wherein said long distance is at least three times as long as said short distance.

* * * * *